US005851963A

United States Patent [19]

O'Bryant

[11] Patent Number: 5,851,963

[45] Date of Patent: Dec. 22, 1998

[54] ORGANIC LUBRICANT

[76] Inventor: Jeffrey Charles O'Bryant, 23707 13th Pl. S. Apt. 2, Des Moines, Wash. 98198

[21] Appl. No.: 897,891

[22] Filed: Jul. 21, 1997

[51] Int. Cl.[6] ..... C10M 9/00; C10M 173/02

[52] U.S. Cl. ..... 508/216

[58] Field of Search ..... 508/216

[56] References Cited

U.S. PATENT DOCUMENTS

| | | | |
|---|---|---|---|
| 4,059,604 | 11/1977 | Kresse | 554/14 |
| 4,115,282 | 9/1978 | Grasshoff | 508/216 |
| 4,154,822 | 5/1979 | Polimeni et al. | 424/180 |
| 4,233,075 | 11/1980 | Picone | 106/3 |
| 4,636,321 | 1/1987 | Kipp et al. | 508/431 |
| 5,008,108 | 4/1991 | Rha et al. | 424/401 |
| 5,254,272 | 10/1993 | Walters et al. | 508/294 |
| 5,302,305 | 4/1994 | Jolley et al. | 508/427 |
| 5,334,318 | 8/1994 | Vinci et al. | 508/240 |
| 5,372,736 | 12/1994 | Trivett | 508/491 |
| 5,534,172 | 7/1996 | Perry et al. | 508/156 |

*Primary Examiner*—Ellen M. McAvoy
*Attorney, Agent, or Firm*—Klarquist Sparkman Campbell Leigh & Whinston, LLP

[57] ABSTRACT

A new organic lubricant for lubricating and cooling tools. The inventive composition is prepared by soaking an amount of okra in a volume of water for a length of time and then straining said okra from the mixture of water and okra so that the remaining mixture forms the organic lubricant. Optionally, the remaining mixture may further evaporated to form a concentrated version of the organic lubricant. Also optionally, preservatives may be added to the organic lubricant to delay the fermentation or decomposition of the organic lubricant.

9 Claims, No Drawings

ORGANIC LUBRICANT

BACKGROUND OF THE INVENTION

1. Field of the Invention

The present invention relates to lubricants and more particularly pertains to a new organic lubricant for lubricating and cooling tools.

2. Description of the Prior Art

The use of lubricants is known in the prior art. More specifically, lubricants heretofore devised and utilized are known to consist basically of familiar, expected and obvious elements, notwithstanding the myriad of compositions encompassed by the crowded prior art which have been developed for the fulfillment of countless objectives and requirements.

Known prior art lubricants include U.S. Pat. Nos. 4,233,075; 5,372,736; 5,254,272; 4,636,321; 5,302,305; and 5,334,318.

While these devices fulfill their respective, particular objectives and requirements, the aforementioned patents do not disclose a new organic lubricant. Advantageously, the present invention teaches how to prepare an organic lubricant by soaking an amount of okra in a volume of water for a length of time and then straining said okra from the mixture of water and okra so that the remaining mixture forms the organic lubricant. Optionally, the remaining mixture may be further evaporated to form a concentrated version of the organic lubricant. Also optionally, preservatives may be added to the organic lubricant to delay the fermentation or decomposition of the organic lubricant.

In these respects, the organic lubricant according to the present invention substantially departs from the conventional concepts and designs of the prior art, and in so doing provides compositions primarily developed for the purpose of lubricating and cooling tools.

SUMMARY OF THE INVENTION

In view of the foregoing disadvantages inherent in the known types of lubricants now present in the prior art, the present invention provides a new organic lubricant construction wherein the same can be utilized for lubricating and cooling tools.

The general purpose of the present invention, which will be described subsequently in greater detail, is to provide a new organic lubricant, and methods of applying such, which has many of the advantages of the lubricants mentioned heretofore and many novel features that result in a new organic lubricant which is not anticipated, rendered obvious, suggested, or even implied by any of the prior art lubricants, either alone or in any combination thereof.

To attain this, the present invention is generally prepared by soaking an amount of okra in a volume of water for a length of time and then straining said okra from the mixture of water and okra so that the remaining mixture forms the organic lubricant. Optionally, the remaining mixture may be further evaporated to form a concentrated version of the organic lubricant. Also optionally, preservatives may be added to the organic lubricant to delay the fermentation or decomposition of the organic lubricant.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new organic lubricant and method of using such which has many of the advantages of the lubricants mentioned heretofore and many novel features that result in a new organic lubricant which is not anticipated, rendered obvious, suggested, or even implied by any of the prior art lubricants, either alone or in any combination thereof.

It is another object of the present invention to provide a new organic lubricant which may be easily and efficiently manufactured and marketed.

An even further object of the present invention is to provide a new organic lubricant which is susceptible of a low cost of manufacture with regard to both materials and labor, and which accordingly is then susceptible of low prices of sale to the consuming public, thereby making such organic lubricant economically available to the buying public.

Still yet another object of the present invention is to provide a new organic lubricant which provides in the compositions and methods of the prior art some of the advantages thereof, while simultaneously overcoming some of the disadvantages normally associated therewith.

Still another object of the present invention is to provide a new organic lubricant for lubricating and cooling tools.

Yet another object of the present invention is to provide a new organic lubricant which is prepared by soaking an amount of okra in a volume of water for a length of time and then straining said okra from the mixture of water and okra so that the remaining mixture forms the organic lubricant. Optionally, the remaining mixture may further evaporated to form a concentrated version of the organic lubricant. Also optionally, preservatives may be added to the organic lubricant to delay the fermentation or decomposition of the organic lubricant.

Still yet another object of the present invention is to provide a new organic lubricant that is a biodegradable lubricant and coolant for saw blades.

Even still another object of the present invention is to provide a new organic lubricant that can also be used as an anti-static electricity gel.

Even still another object of the present invention is to provide a new organic lubricant that can also be used as a friction reducing coating for watercraft.

These together with other objects of the invention, along with the various features of novelty which characterize the invention, are pointed out with particularity in the claims annexed to and forming a part of this disclosure.

DESCRIPTION OF THE PREFERRED EMBODIMENT

A unique combination of ingredients has been discovered that advantageously provides a desirable lubricant and coolant. When prepared, the ingredients of the present invention advantageously form compositions that when applied to cutting surfaces of tools provide an effective biodegradable lubricant and coolant to the cutting surfaces. Typically, the lubricant can be applied to most surfaces as an anti-friction agent.

Essential Components

The compositions used in the present invention to make the organic lubricant generally are vegetable okra and water.

Okra is available in supermarkets and other stores. The okra used to make the organic lubricant may be both fresh or frozen. Typically, frozen okra is boiled in water before it is frozen and packaged thereby removing some of its lubricating elements. Therefore, when using frozen okra to make the organic lubricant, more frozen okra should be added to the water than what is used when just using fresh okra.

The okra is soaked for a period of time in water to produce the organic lubricant. Preferably, about 1 pound of okra is used for every 4 gallons of water used. If only frozen okra is used, about 1.5 pounds for every 4 gallons of water should be used. The okra may soak in the water for several days. It is recommended that cold water or warm water is used. However, boiling water should not be used because it causes the break down of the lubricating properties of the okra. Preferably, the okra should soak in the water for at least 24 hours.

After the okra has soaked in the water for a length of time, the okra is strained from the mixture. The remaining strained mixture is the basic organic lubricant. The organic lubricant can be used as is or more water can be removed by an evaporator to produce a condensed version of the lubricant.

The organic lubricant may then be used to coat tools such as saw blades as an effective lubricant. This invention is especially useful for lubricating saw blades in saw mills.

The organic lubricant can also be used to coat the exterior surfaces of water craft to reduce the water resistance when moving in a body of water.

Optional Ingredients

Advantageously, the present invention can generally be formulated with optional ingredients to further customize it. These ingredients will generally be used in amounts that do not alter the desired properties of the system. Ingredients that may be added as preservatives to retard the fermentation and decomposition of the organic lubricant. Preferably, theses ingredients are added to the organic lubricant after the vegetable okra has been removed from the okra-water mixture. These preservative ingredients include grapefruit seed extract, sodium sulfite, isopropyl alcohol, citric acid, calcium proprianate, EDTA, propylene glycol, and olive leaf extract.

The foregoing is therefore considered as illustrative only of the principles of the invention. Further, it should be understood that since numerous modifications and changes will readily occur to those skilled in the art, it is not desired to limit the invention to the exact combinations and ingredients shown and described, and accordingly, all suitable modifications and equivalents may be resorted to, falling within the scope of the invention.

The following non-limiting examples, which include the best mode, are set forth to illustrate the present invention.

EXAMPLE 1

An organic lubricant was produced by mixing 1 pound of fresh okra in a 4 gallon volume of water. The okra was soaked in the water for 24 hours. The soaking okra was then removed from the mixture. The remaining mixture formed the organic lubricant.

EXAMPLE 2

An organic lubricant was produced by mixing pound of fresh okra in a 4 gallon volume of water of room temperature water. The okra was soaked in the water for 24 hours. The soaking okra was then removed from the mixture. The remaining mixture was then placed in an evaporator until enough water was evaporated so that one gallon of liquid remained. This evaporated remaining mixture formed the organic lubricant.

EXAMPLE 3

An organic lubricant was produced by mixing pound of fresh okra in a 4 gallon volume of water of room temperature water. The okra was soaked in the water for 24 hours. Two tablets of sodium sulfite were then mixed with the remaining mixture to complete the formation of the organic lubricant.

EXAMPLE 4

An organic lubricant was produced by mixing pound of fresh okra in a 4 gallon volume of water of room temperature water. The okra was soaked in the water for 24 hours. 2% of the finished volume of lubricant of grapefruit seed extract from Nutri-Biotics—Lakeport Calif. 95453 were then mixed as a preservative with the remaining mixture to complete the formation of the organic lubricant.

The above compositions were applied to the exterior surfaces the cutting surfaces of a power saw to function as a lubricant when cutting materials.

I claim:

1. A process for making an organic lubricant, comprising:

(a) providing a volume of water;

(b) providing an amount of okra;

(c) said amount of okra in said volume of water for a length of time;

(d) straining said okra from the mixture of water and okra; and (e) adding a sufficient amount of a preservative to the remaining strained mixture, to help inhibit decomposition of the organic lubricant.

2. The organic lubricant made by the process in claim 1.

3. The process of claim 1, further comprising the additional step of evaporating water from said remaining strained mixture to form a concentrated mixture, wherein said concentrated mixture is said organic lubricant.

4. The process of claim 1, further comprising the additional step of adding an ingredient selected from the group consisting of sodium sulfite, ethanol, citric acid, calcium proprianate, EDTA, and propylene glycol.

5. The process of claim 1, wherein the volume of water provided is selected from the range between 1 gallon and 4 gallons.

6. The process of claim 1, wherein said amount of okra provided weighs at least 1 pound.

7. The process of claim 1, wherein at least 1 pound of okra is provided for every 4 gallons of water provided.

8. A process for making an organic lubricant, which comprises:

(a) providing a volume of water of at least 4 gallons;

(b) providing an amount of okra weighing at least 1 pound;

(c) soaking said amount of okra in said volume of water for a length of time of at least 1 day;

(d) straining said okra from the mixture of water and okra;

(e) evaporating water from the remaining strained mixture to form a concentrated mixture; and (f) adding an additional ingredient to said concentrated mixture, wherein said additional ingredient is selected from the group consisting of sodium sulfite, ethanol, citric acid, calcium proprianate, EDTA, and propylene glycol.

9. The organic lubricant made by the process in claim 8.

* * * * *